US011202479B2

(12) United States Patent
Collins et al.

(10) Patent No.: US 11,202,479 B2
(45) Date of Patent: Dec. 21, 2021

(54) EXOSKELETON FRAME TO SUPPORT HEAVY APPAREL

(71) Applicant: CARDIOLOGYCODER.COM INC., Saratoga Springs, NY (US)

(72) Inventors: James Collins, Saratoga Springs, NY (US); Ted Schulte, Saratoga Springs, NY (US)

(73) Assignee: CARDIOLOGYCODER.COM INC., Saratoga Springs, NY (US)

( * ) Notice: Subject to any disclaimer, the term of this patent is extended or adjusted under 35 U.S.C. 154(b) by 0 days.

(21) Appl. No.: 16/707,472

(22) Filed: Dec. 9, 2019

(65) Prior Publication Data

US 2020/0178678 A1 Jun. 11, 2020

Related U.S. Application Data

(60) Provisional application No. 62/777,317, filed on Dec. 10, 2018.

(51) Int. Cl.
*A41F 19/00* (2006.01)
*G21F 3/02* (2006.01)

(52) U.S. Cl.
CPC ..... *A41F 19/00* (2013.01); *G21F 3/02* (2013.01)

(58) Field of Classification Search
CPC ..... A45F 3/06; A45F 3/10; G21F 3/02; G21F 3/03; A41D 13/04; A41D 2400/44; A41F 19/00
USPC ..... D29/100, 101.4
See application file for complete search history.

(56) References Cited

U.S. PATENT DOCUMENTS 744,477 A * 11/1903 Bush ..... A45F 5/00 224/265
3,035,747 A * 5/1962 Ullrich, Jr. ..... B63C 11/30 224/265
3,996,620 A * 12/1976 Maine ..... A41D 13/04 2/457
4,441,025 A * 4/1984 McCoy, Jr. ..... G21F 3/03 2/2.5

(Continued)

OTHER PUBLICATIONS

Pelz, "Low Back Pack, Lead Aprons, and the Angiographer," Am. J. Neuroradiology, Aug. 2000, 1 page.

(Continued)

*Primary Examiner* — Justin M Larson
(74) *Attorney, Agent, or Firm* — Schmeiser, Olsen & Watts, LLP

(57) ABSTRACT

An exoskeleton frame having a frame body that includes a front torso member and a back torso member. The frame body further includes a first shoulder band and a second shoulder band each extending from the front torso member to the back torso member, and an opening positioned between the first shoulder band and second shoulder band. The exoskeleton frame further has an adjustable belt removably attached to the front torso and back torso member that is configured to direct a weight of apparel that is worn by the user over the exoskeleton frame to a weight-bearing area of the user located between knees and abdomen of the user, wherein the first shoulder band and second shoulder band are configured to support the weight of the apparel such that the weight of the apparel is not applied to a first shoulder or a second shoulder of the user.

22 Claims, 6 Drawing Sheets

(56) References Cited

U.S. PATENT DOCUMENTS 4,527,288 A * 7/1985 Hoffman ..... A41D 13/04 2/48
4,602,386 A * 7/1986 Hoffman ..... A41D 13/04 2/300
4,892,240 A * 1/1990 Bell ..... A45F 3/08 224/153
5,183,194 A * 2/1993 Shirdavani ..... A41F 9/002 2/45
5,220,175 A * 6/1993 Cole ..... G21F 3/02 250/515.1
5,356,190 A * 10/1994 Torres ..... A45F 5/1046 294/166
5,464,137 A * 11/1995 Shirdavani ..... A41F 9/002 2/45
D376,611 S * 12/1996 Field ..... 224/265
5,626,270 A * 5/1997 Tseng ..... A61M 5/1415 128/DIG. 6
5,834,789 A * 11/1998 Marchione ..... G21F 3/02 250/516.1
5,844,246 A * 12/1998 Marchione ..... G21F 3/02 250/516.1
5,846,169 A * 12/1998 Tscheschlog ..... A63B 21/4005 482/105
D430,958 S * 9/2000 Stiff ..... D29/100
D470,979 S * 2/2003 Banton ..... D29/101.1
D482,499 S * 11/2003 Garrido ..... D29/100
6,908,019 B2 * 6/2005 Parsons ..... A45F 5/02 224/251
D631,611 S * 1/2011 Sattler ..... D29/101.4
8,182,439 B2 5/2012 Glenn
8,330,133 B2 * 12/2012 Gold ..... A61B 6/107 250/516.1
8,444,031 B2 * 5/2013 Bonnet ..... A45F 3/10 224/265
8,777,168 B2 * 7/2014 Hassid ..... A47G 25/0671 248/125.8
9,055,806 B2 * 6/2015 Ferrer Wetter ..... A45F 3/08
9,198,470 B1 * 12/2015 Monir ..... F16M 13/027
9,504,307 B1 * 11/2016 Burnett ..... A45F 3/10
9,629,443 B2 * 4/2017 Searle ..... A45F 3/14
9,918,540 B2 * 3/2018 Fawcett ..... A45F 3/00
10,020,083 B1 * 7/2018 Heesch ..... A61B 6/107
10,688,654 B2 * 6/2020 Wang ..... B25J 9/0006
10,729,195 B2 * 8/2020 Truelove, III ..... G21F 3/02
2002/0153401 A1 * 10/2002 Werling ..... A45F 3/14 224/625
2010/0263111 A1 * 10/2010 Leatt ..... A41D 13/0512 2/467
2011/0163139 A1 * 7/2011 Ferrer Wetter ..... A45F 3/10 224/265
2013/0270462 A1 * 10/2013 Beck ..... A47B 83/00 250/516.1
2017/0027245 A1 * 2/2017 Miller ..... G21F 3/02
2018/0257217 A1 * 9/2018 Johnson ..... A61F 5/0102
2020/0118166 A1 * 4/2020 Miller ..... G06F 1/26
2020/0155264 A1 * 5/2020 Waterman ..... A41D 13/0002
2020/0178678 A1 * 6/2020 Collins ..... A45F 3/14

OTHER PUBLICATIONS

Goldstein et al., "Occupational Hazards of Interventional Cardiologists: Prevalence of Orthopedic Health Problems in Contemporary Practice," Catheterization and Cardiovasc. Interv. 63:407-411 (Dec. 2004). 5 pages.
Dehmer, "Occupational Hazards for Interventional Cardiologists," SCAI Presidents Page, Catheterization and Cardiovasc. Interv. 68:974-976 (Nov. 2006). 4 pages.
Birnie et al., "Prevalence and Risk Factors for Cervical and Lumbar Spondylosis in Interventional Electrophysiologists," J. Cardiovasc. Electrophysiology, vol. 22, No. 9 957-960 (Sep. 2011). 4 pages.
Chambers et al., "Cath Lab Hazard: Orthopedic Injuries," Cardiology Today's Interventiion, Jul./Aug. 2015. 3 pages.
Dixon et al., "Society of Interventional Radiology: Occupational Back and Neck Pain and the Interventional Radiologist," J. Vasc. Interv. Radiol. vol. 28, No. 2, 195-199 (Feb. 2017). 5 pages.
Gupta, "Cath Lab Hazards: Combat Them With Knowledge," TCTMD/The Heart Beat (Nov. 7, 2018). 1 page.
Orme et al., "Occupational Health Hazards of Working in the Interventional Laboratory: A Multisite Case Control Study of Physicians and Allied Staff," Am. J. Cardiol., vol. 65, No. 8, 820-826 (Mar. 3, 2015). 7 pages.
Tomes et al., "The impact of body armor on physical performance of law enforcement personnel: a systematic review," Annals of Occupational and Environmental Medicine, 29:14 (2017). 15 pages.
Burton, "Weight of War: Gear that protects troops also injures them," Seattle Times (Feb. 12, 2011). 5 pages.
Lyons et al., "A Profile of Injuries Sustained by Law Enforcement Officers: A Critical Review," Int. J. Environ Res. Public Health, 14, 142 (2017). 21 pages.
Konitzer et al., "Association between Back, Neck, and Upper Extremeity Musculoskeletal Pain and the Individual Body Armor," J. Hand Ther. 21:143-149 (Apr.-Jun. 2008). 7 pages.
Majumdar et al., "Physiological effects of wearing heavy body armour on male soldiers," Int. J. Ind. Ergo. vol. 20, 155-161 (1997). 7 pages.
Rees et al., "Get the Lead off our Backs!," Tech Vasc and Interventional Rad 21:7-15 (2018). 9 pages.
Ross et al., "Prevalence of Spinal Disc Disease Among Interventional Cardiologists," Am. J. Cardiol., 79, 68-70 (1997). 3 pages.

* cited by examiner

EXOSKELETON FRAME TO SUPPORT HEAVY APPAREL

CROSS-REFERENCE TO RELATED APPLICATIONS

This application claims priority to U.S. Provisional Application No. 62/777,317 filed Dec. 10, 2018, the entirety of which is incorporated by reference.

TECHNICAL FIELD

The technical field relates to wearable protective garments. Specifically, the technical field relates to a wearable exoskeleton frame that supports heavy apparel worn by a user.

BACKGROUND

In various fields and professions, workers often wear heavy apparel or safety apparatuses while they perform their duties. Military, police, and other law enforcement personnel often need to wear protective body armor that may weigh more than protective gear in other professions. Firefighters often wear Kevlar coats, water-resistant layers, and heat insulation which combined can weigh over fifty pounds, and physicians and other health care staff who work near x-rays or CT scanners often wear heavy lead aprons to protect them from radiation. The weight of protective apparel is often applied directly on a user's shoulders and spine causing fatigue, poor posture, injury, overheating, skin irritation, and decreased productivity. An exoskeleton frame that decreases the force and weight applied to a user's shoulders and spine by heavy apparel would be well received in the art.

SUMMARY

According to one aspect, an exoskeleton frame includes a frame body including a front torso member positioned such that when the exoskeleton frame is worn by a user the front torso member is located along a front of a torso of the user; a back torso member positioned such that when the exoskeleton frame is worn by a user the back torso member is located along a back of the torso of the user; a first shoulder band extending from the front torso member to the back torso member; and a second shoulder band extending from the front torso member to the back torso member; and an adjustable belt removably attached to the front torso and back torso member, wherein the adjustable belt is configured to direct a weight of apparel that is worn by the user over the exoskeleton frame to a weight-bearing area of the user located between knees and abdomen of the user, wherein the first shoulder band and second shoulder band are configured to support the weight of the apparel such that the weight of the apparel is not applied to a first shoulder or a second shoulder of the user.

According to another aspect, a method for making an exoskeleton frame comprising providing a piece of material; forming a preformed frame body out of the piece of material, such that the preformed frame body includes a first shoulder band, a second shoulder band, an opening between the first shoulder band and second shoulder band, a front torso member, and a back torso member; and manipulating the preformed frame body into a frame body such that when the frame body is worn by a user, the front torso member is located in front of a torso of the user and the back torso member is located along a back of the torso of the user, and the first shoulder band and second shoulder band are configured to support the weight of apparel that is worn by the user over the frame body such that the weight of the apparel is held off of a first shoulder and a second shoulder of the user.

According to another aspect, an exoskeleton frame comprises a frame body including a front torso member positioned such that when the exoskeleton frame is worn by a user the front torso member is located along a front of a torso of the user; a back torso member positioned such that when the exoskeleton frame is worn by a user the back torso member is located along a back of the torso of the user; a first shoulder band extending from the front torso member to the back torso member; a second shoulder band extending from the front torso member to the back torso member; and an opening positioned between the first shoulder band and second shoulder band such that when the exoskeleton frame is worn by a user, a neck of the user is located within the opening, wherein the front torso member and back torso member are configured to receive an adjustable belt that is configured to direct a weight of apparel that is worn by the user over the exoskeleton frame to a weight-bearing area of the user located between knees and abdomen of the user, wherein the first shoulder band and second shoulder band are configured to support the weight of the apparel such that the weight of the apparel is held off of a first shoulder and a second shoulder of the user.

DESCRIPTION

A detailed description of the hereinafter-described embodiments of the disclosed apparatus and method are presented herein by way of exemplification and not limitation with reference made to the Figures. Although certain embodiments are shown and described in detail, it should be understood that various changes and modifications might be made without departing from the scope of the appended claims. The scope of the present disclosure will in no way be limited to the number of constituting components, the materials thereof, the shapes thereof, colors thereof, the relative arrangement thereof, etc., and are disclosed simply as an example of embodiments of the present disclosure. A more complete understanding of the present embodiments and advantages thereof may be acquired by referring to the following description taken in conjunction with the accompanying drawings, in which like reference numbers indicate like features.

Figure 1:
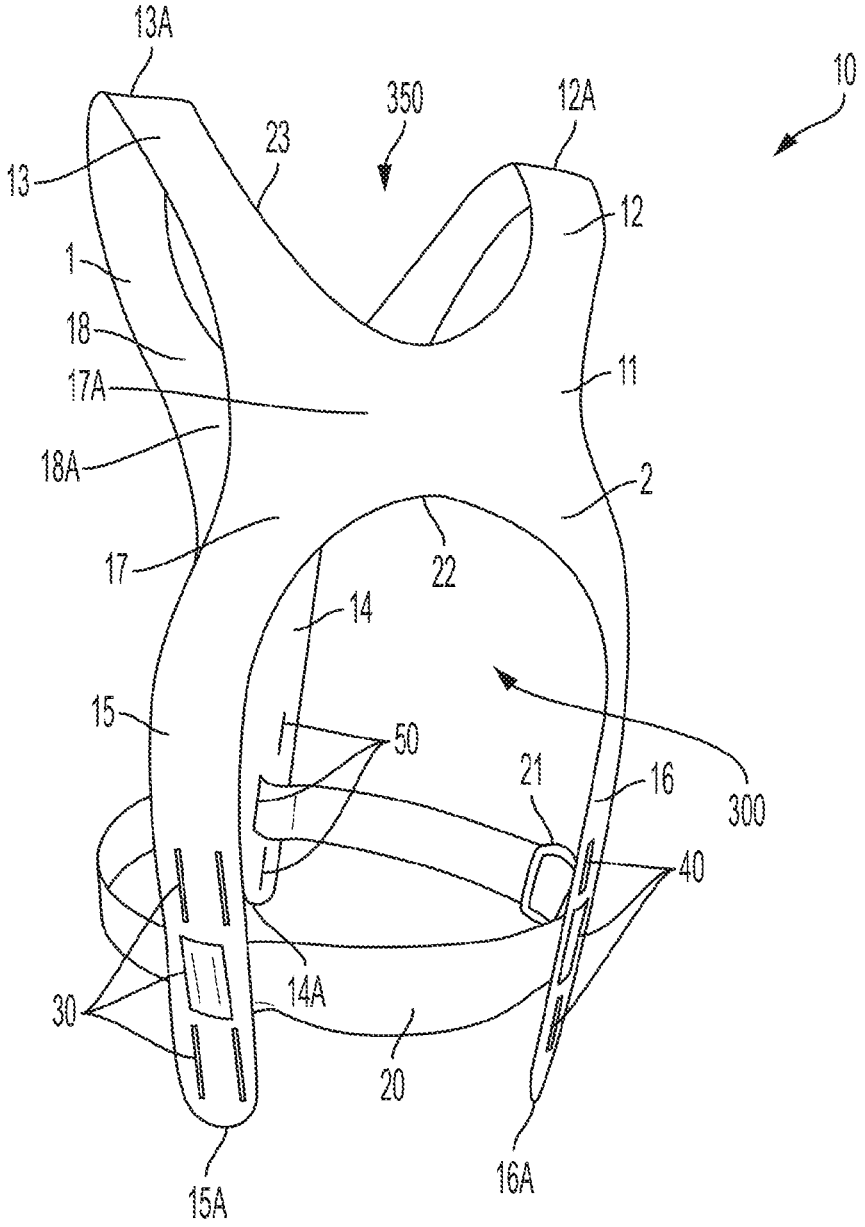
FIG. 1 depicts a perspective view of an exoskeleton frame.

With reference to FIG. 1, a perspective view of an exoskeleton frame 10 is shown according to one embodiment. The exoskeleton frame 10 is configured to be worn by a user (as hereinafter shown and described with respect to FIG. 4). The exoskeleton frame 10 includes a frame body 11 and a belt 20. The frame body 11 is made of a curved piece of material. The frame body 11 includes a front torso member 17 and a back torso member 18. The exoskeleton frame includes a first shoulder band 12 and a second shoulder band 13 that each extend between the front torso member 17 and the back torso member 18. The first shoulder band 12 has a first top edge 12A, and the second shoulder band 13 has a second top edge 13A. The frame body 11 has an inner surface 1 and an outer surface 2. The frame body 11 may be rigid. The frame body may be semi-rigid and have flexibility.

In this embodiment, the back torso member 18 includes a back plate 18A and a first vertical element 14 that extends from the back plate 18A to a first end 14A of the first vertical element 14. The first and second shoulder bands 12, 13 extend from the back plate 18A opposite the first vertical element 14. The front torso member 17 has a chest plate 17A, which is located in front of a chest area of the user when the exoskeleton frame 10 is worn by a user. The front torso member 17 includes a second vertical element 15 extending from the chest plate 17A opposite the second shoulder band 13 to a second end 15A of the second vertical element 15. The front torso member 17 further includes a third vertical element 16 extending from the chest plate 17A opposite the first shoulder band 12 to a third end 16A of the third vertical element 16. The first, second, and third ends 14A, 15A, 16A may be flat, rounded, or have another shape. In this embodiment, the first end 14A is flat, and the second and third ends 15A, 16A are rounded. The chest plate 17A and back plate 18A may each be a panel, a plate, a plaque, a surface, and the like. The exoskeleton frame 10 is not limited to having a back torso member 18 with a first vertical element 14. For example, the back torso member 18 may have one or more vertical elements. Further, the front torso member 17 is not limited to having a second and a third vertical element 15, 16, and may have less than two or more than two vertical elements.

The exoskeleton frame 10 has a first edge 22 that extends around the frame body 11 and abuts the inner surface 1 and outer surface 2 of the frame body 11. The frame body 11 further includes an opening 350 having a second edge 23 defined by the first and second shoulder bands 12, 13, the front torso member 17, and the back torso member 18. When the exoskeleton frame 10 is worn by the user, the user's neck and head are located within the opening 350. In an embodiment, the first and second edges 22, 23 may be enclosed in a soft material such as rubber, fabric, and the like. For example, the first and second edges 22, 23 may have a rubber lip, a fabric hem, a soft border, and the like. As another example, the first and second edges 22, 23 may be rounded.

A "U" shaped space 300 is provided between the second vertical element 15, the third vertical element 16, and chest plate 17A. In this embodiment, the space 300 is "U" shaped. The space 300 may have another shape, such as a "V" shape or other shape. In an embodiment, the second and third vertical elements 15, 16 may not be straight, and may have shape that provides a different shape space 300, such as a circular space, rectangular space, and the like. The space 300 is configured to accommodate differently sized users wearing the exoskeleton frame 10 such that the exoskeleton frame 10 does not place pressure onto a stomach area of the user, or obstruct a user's stomach area from extending to its natural extent.

With continuing reference to FIG. 1, in this embodiment, the front torso member 17 has a curved shape such that when the exoskeleton frame 10 is worn by a user, the chest plate 17A curves about the front of the user's chest area. The curve of the front torso member 17 may be configured such that when the exoskeleton frame 10 is worn by the user, the inner surface 1 at the second and third vertical elements 15, 16 lays flat along or against the front of the user's torso. The curve of the front torso member 17 may be configured to mimic the curve and shape of a user's torso such that when apparel is worn over the exoskeleton frame 10, the apparel falls or lays naturally as if worn on a user's body without an exoskeleton frame such as exoskeleton frame 10. The exoskeleton frame 10 may have flexibility such that when the exoskeleton frame 10 is worn by the user, the second and third vertical elements 15, 16 are flat along or against the front of the user's torso. As another example, the second and third vertical elements 15, 16 may have flexibility such that when the exoskeleton frame 10 is worn by the user, the inner surface 1 of the second and third vertical elements 15, 16 is flat along or against the front of the user's torso on either side of the space 300.

The first vertical element 14 has a first plurality of slits 50 located proximate to the first end 14A. The second vertical element 15 has a second plurality of slits 30 located proximate to the second end 15A. The third vertical element 16 has a third plurality of slits 40 located proximate to the third end 16A. In this embodiment, the first, second, and third pluralities 50, 30, 40 of slits include 3 pairs of parallel slits arranged on top of one another along the first, second, and third vertical elements 14, 15, 16. Each pair of slits is configured to receive the belt 20 such that the belt is attached to the frame body 11 and the exoskeleton frame 10 is securable to a user. The arrangement of pairs of slits along each of the first, second, and third vertical members 14, 15, 16 provides for adjustable fit of the exoskeleton frame 10 on a user such that a user of any height can wear the exoskeleton frame 10. For example, a user with a shorter torso may insert the belt 20 through the top-most pair of slits of the first, second, and third pluralities of slits 50, 30, 40, and a user having a longer torso may insert the belt through the pair of slits closest to the first, second, and third ends 14A, 15A, 16A. The pairs of slits closest to the first, second, and third ends 14A, 15A, 16A may be one (1) inch away from the first, second, and third ends 14A, 15A, 16A. As another example the pairs of slits closest to the first, second, and third ends 14A, 15A, 16A may be more than one inch from the first, second, and third ends 14A, 15A, 16A, for example, two (2) to six (6) inches, and the like. Each of the first, second, and third vertical elements 14, 15, 16 may include any number of slits or other belt attachment structures.

The exoskeleton frame 10 may include other belt attachment structures, and is not limited to receiving the belt 20 by a first, second, and third pluralities of slits 50, 30, 40. For example, the first, second, and third vertical members 14, 15, 16 may include one or more holes, slots, bores, cuts, spaces, openings, apertures, eyelets, buttons, hook and loop surfaces, fasteners, ties, hooks, tabs, and the like that are configured to removably receive or attach the belt 20 to the exoskeleton frame 10. As another example, the first, second, and third vertical elements 14, 15, 16 may each include a vertically adjustable track. For example, the first, second, and third vertical elements 14, 15, 16 may each include a plurality of notches arranged vertically on a track, and the belt 20 may be affixed to each of the vertically adjustable tracks such that the arrangement of the belt 20 along each of the first, second, and third vertical elements 14, 15, 16 is adjustable along each track by the notches.

As shown in FIG. 1, the belt 20 is removably attached to the first, second, and third vertical elements 14, 15, 16 by being inserted through a pair of slits on each of the first, second, and third vertical elements 14, 15, 16. The belt 20 may also be removably attached to the exoskeleton frame 10 by being tied to one or more slits of the first, second, and third pluralities of slits 50, 30, 40, laced through one or more slits of the first, second, and third pluralities of slits 50, 30, 40, looped around one or more slits of the first, second, and third pluralities of slits 50, 30, 40, and the like. In this embodiment, each pair of slits of the first, second, and third pluralities of slits 50, 30, 40 are aligned. For example, each middle pair of slits on the first, second, and third vertical elements 14, 15, 16 are aligned such that when the belt 20 is inserted through each middle pair of slits, the belt 20 is configured to extend around the first, second, and third vertical element 14, 15, 16 and horizontally around a weight-bearing area of the user. A weight-bearing area of the user may be an area between the user's knees and abdomen, such as the user's hips, waist, and thighs.

The belt 20 is made out of a flexible material. For example, the belt 20 may be made out of polypropylene webbing, leather, elastic, cord, string, rope, fabric, canvas, and the like. In this embodiment, the belt 20 has a buckle 21 configured to secure the belt 20 to a user at a desired weight-bearing area between the user's knees and abdomen. The belt 20 is not limited to having a buckle 21 and could be securable by hook-and-loop fasteners, fasteners, buttons, magnets, hooks, and the like. The belt 20 is adjustable in length to accommodate differently sized users. For example, an operable length of the belt 20 may be adjusted by pulling the belt through the buckle 21 or other fastener, or by the belt 20 being made out of an elastic material that can stretch and retract based on a user's dimensions. The buckle 21 is oriented such that a user can access the buckle 21 when the exoskeleton frame 10 is worn by the user such that the user can secure and unsecure the exoskeleton frame 10 to the user.

In another embodiment, instead of a flexible belt 20, the exoskeleton frame 10 may include a rigid support structure including a rigid belt configured to fit around the weight-bearing area of the user's body. A rigid belt may include one or more segments, such as a "C" shaped rigid segment extending from the first vertical element 14 to the second, and third vertical elements 15, 16 and one or more moveable segments between the second and third vertical elements 15, 16 configured to open to receive a user and configured to secure closed into a continuous rigid belt around the weight-bearing area of the user. For example, one or more moveable segments of a rigid belt may be hingedly or foldably attached to the second and third vertical elements 15, 16.

With continuing reference to FIG. 1, the frame body 11 may be made of a rigid, or semi-rigid material, such as plastic. The frame body 11 may be made of low-density polyethylene. The frame body 11 may include a high-density polymer. In one embodiment, the frame body 11 may be made out of a material that attenuates x-rays such that a user, for example, a physician who needs to wear a protective garment such as a lead apron, may wear a lead apron that weighs less than a standard lead apron on top of the exoskeleton frame 10 because of the additional x-ray attenuation provided by the frame body 11 of the exoskeleton frame 10. In another embodiment, the frame body 11 may provide all x-ray attenuation needed for the user such that a lead apron does not need to be worn in the presence of x-rays or CT scanner.

With continuing reference to FIG. 1, in this embodiment, the front torso member 17 and second torso member 18 are flexibly movable apart from one another to accommodate users having differently sized torsos. To accommodate a wider user, the belt 20 may be loosened, for example, at buckle 21, such that the user fits between the back torso member 17 and front torso member 18. To accommodate a narrower user, the belt 20 may be tightened, for example, at buckle 21, such that the space between the front torso member 17 and back torso member 18 is narrower.

Figure 2:
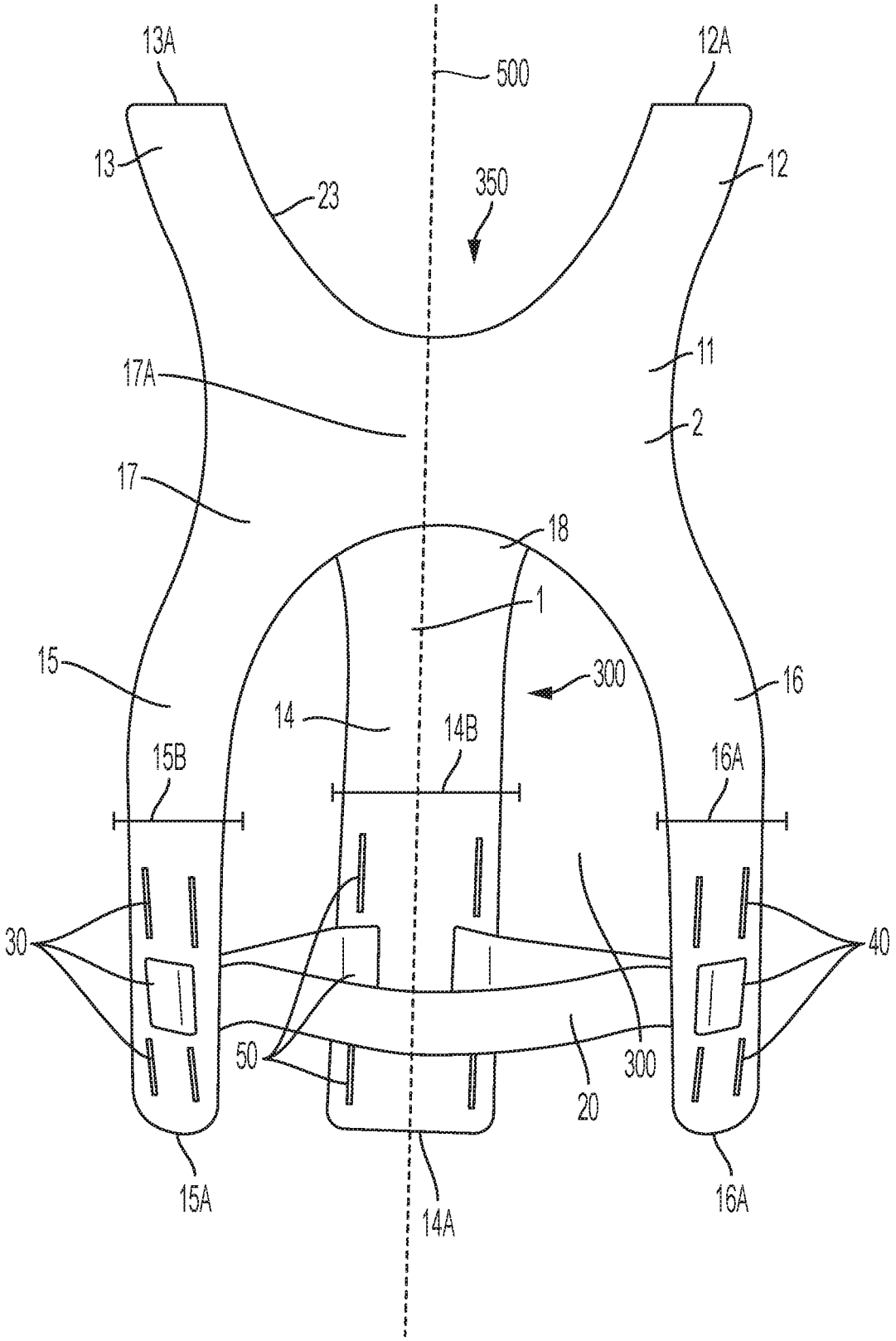
FIG. 2 depicts a front view of the exoskeleton frame of FIG. 1.

With reference to FIG. 2, a front view of the exoskeleton frame 10 is shown. The exoskeleton frame 10 is symmetrical down a center line 500. The first, second, and third ends 14A, 15A, 16A are aligned in this embodiment. In another embodiment, the first, second, and third ends 14A, 15A, 16A may not be aligned. For example, in one embodiment, the second and third vertical elements 15, 16 may extend longer than the first vertical member 14 such that the second and third ends 15A and 16A are below the first end 14A. In another embodiment, the first vertical element 14 may extend longer than the second and third elements 15, 16 such that the first end 14A is lower than the second and third ends 15A, 16A. With continuing reference to FIG. 2, in this embodiment, the first, second, and third vertical 14, 15, 16 have a straight shape. In another embodiment, the first, second, and third element 14, 15, 16 may have a different shape, such as a wavy or curved shape.

The first vertical element 14 has a first width 14B, the second vertical element 15 has a second width 15B, and the third vertical element 16 has a third width 16B. The second width 15B of the second vertical element 15 and third width 16B of the third vertical element 16 are equal in this embodiment. The first width 14B of the first vertical element 14 is wider than the second and third widths 15B, 16B in this embodiment. In another embodiment, the first, second, and third widths 14B, 15B, 16B may be equal. In another embodiment, the second and third vertical elements 15, 16 may be wider than the first vertical element 14.

Figure 3:
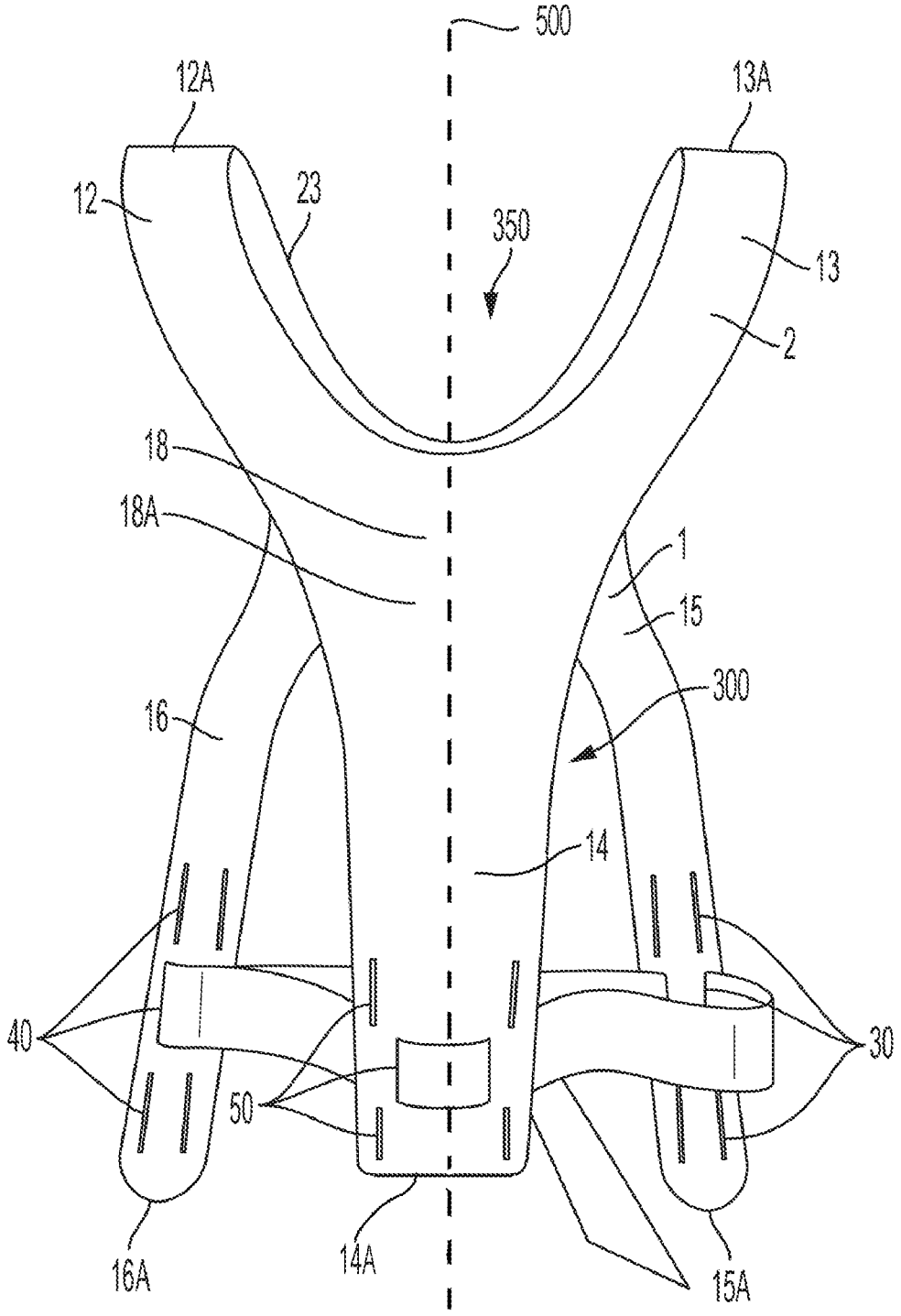
FIG. 3 depicts a back view of the exoskeleton frame of FIGS. 1 and 2.

With reference to FIG. 3, a back view of the exoskeleton frame 10 is shown. In this embodiment, the back torso member 18 of the exoskeleton frame 10 has a "Y" shape that extends from the first end 14A to the first and second top edges 12A, 13A of the first and second shoulder bands 12, 13.

In another embodiment, the frame body 11 may be separable into two pieces. For example, the frame body may be separable into pieces that separate at the first shoulder band 12 and second shoulder band 13 such that each piece can be stacked on top of the other for storage of the exoskeleton frame 10 when not in use. A first piece may include the front torso portion 17 and a first half of each of the first and second shoulder bands 12, 13 extending from the front torso portion 17, and a second piece may include the back torso portion 18 and a second half of each of the first and second shoulder bands 12, 13. Each half of the shoulder bands 12, 13 may extend to the first and second top edges 12A, 13A of the first and second shoulder bands 12, 13. The separable pieces of the frame body 11 may be assembled into the frame body 11. For example, each of the first halves of the first and second shoulder bands 12, 13 may securably interlock with the second halves of the first and second shoulder bands 12, 13, respectively, for example, by a clamp. As another example, each of the first halves of the first and second shoulder bands 12, 13 may have a protrusion such as a peg, pin, nail, fastener, tab, nub, knob, and the like, configured to be securably inserted into a hole of each of the second halves of the first and second shoulder portions 12, 13, such as a hole, slit, slot, bore, opening, and the like. When not in use, the two pieces are separable and the belt 20 is removable from one of the first or second pieces. The first piece and second piece are then stackable such that the exoskeleton frame 10 can be stored and take up less space than when the exoskeleton frame 10 is fully assembled.

Figure 4:
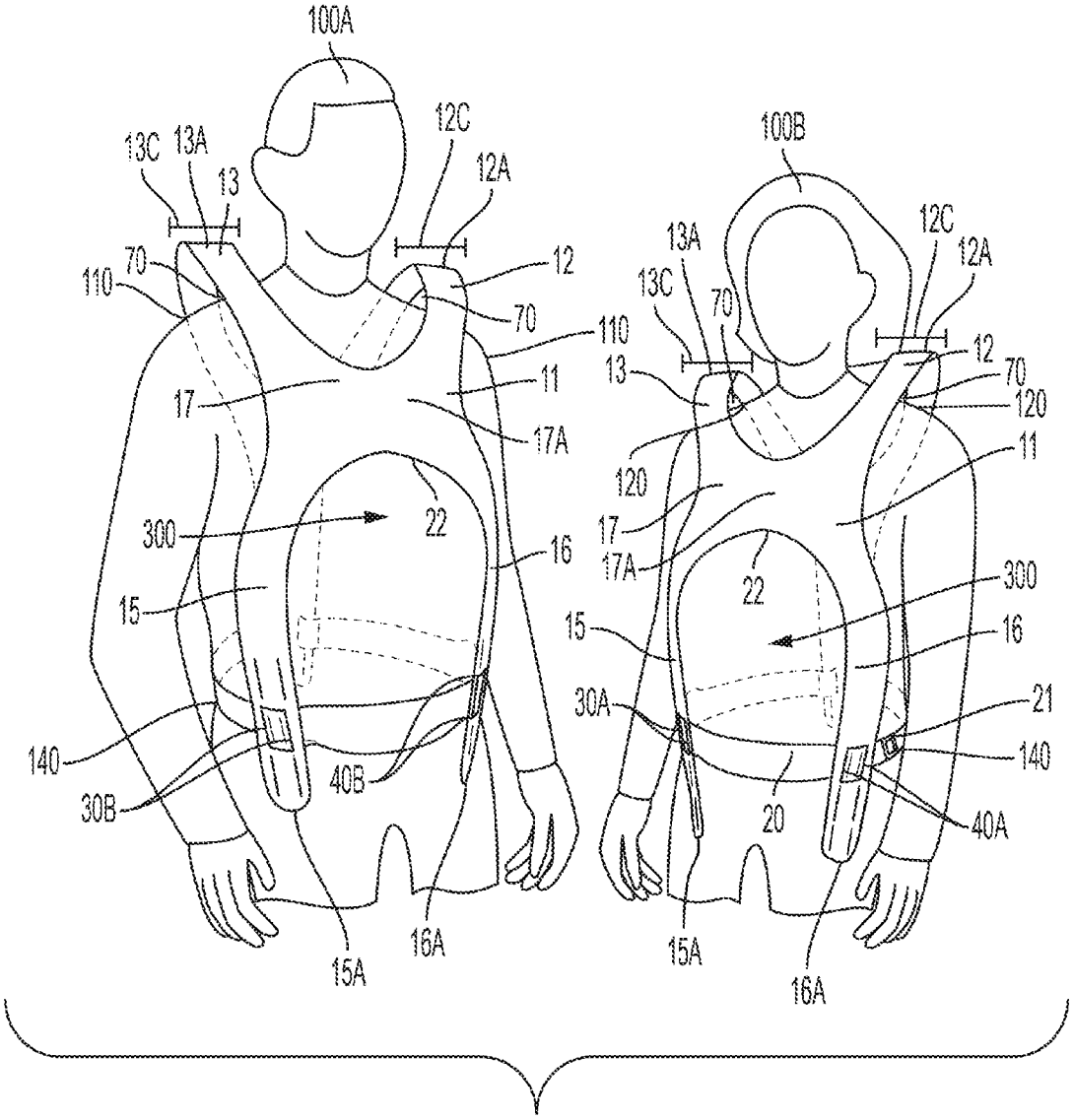
FIG. 4 depicts a perspective view of two users each wearing the exoskeleton frame of FIGS. 1-3.

Referring now to FIG. 4, a perspective view of a first user 100A and a second user 100B each wearing an exoskeleton frame 10 is shown. With respect to each user 100A, 100B, the first vertical element 14 of the exoskeleton frame 10 extends downward along the first and second users' 100A, 100B backs or spines, and the second and third vertical elements 15, 16 are arranged along the fronts of the users' 100A, 100B torsos. The chest plate 17A of the exoskeleton frame 10 is positioned adjacent to a chest area of each of the first and second users 100A, 100B. The inner surface 1 of the frame body 11 is adjacent to the first and second users' 100A, 100B bodies, and the outer surface 2 of the frame body 11 faces away from the first and second users' 100A, 100B bodies.

The belt 20 secures the exoskeleton frame 10 to a weight-bearing area of the users 100A, 110B. A weight-bearing area may be an area between the users' 100A, 100B knees and abdomen. In this embodiment, the belt 20 is secured to each users' 100A, 100B waist 140 such that when a user puts on apparel such as a protective garment over the exoskeleton frame 10, a weight of the apparel is directed to that weight-bearing area of the user and not the user's shoulders or spine.

The belt 20 secures the exoskeleton frame to the user 100A, 100B such that a gap 70 is provided between each of the user's 100A, 100B shoulders, and the first and second shoulder bands 12, 13. For example, as shown with respect to the first user 100A, a gap 70 is provided between each of the first user's 100A shoulders 110 and the first and second shoulder bands 12, 13. As shown with respect to the second user 100B, a gap 70 is provided between each of the second user's 100B shoulders 120 and the first and second shoulder bands 12, 13. When apparel such as a protective garment is worn over the exoskeleton frame 10 (hereinafter shown and described in FIG. 5), the first and second shoulder bands 12, 13 hold the apparel such that the apparel is lifted off and above a users' 100A, 100B shoulders 110, 120, and simultaneously, the belt 20 directs a weight of the apparel to a weight-bearing area of the respective user such as the waist 140 of the user 100A, 100B and off of the user's shoulders, neck, spine, and back. As shown in the embodiment in FIG. 4, the belt 20 is arranged to direct a weight of apparel worn by the first and second users 100A, 100B to the waist 140 of the first and second user 100A, 100B. The belt 20 is securable to the user 100A, 100B such that the weight of apparel worn over the exoskeleton frame 10 is kept on the weight-bearing area of the user such as the user's 110A, 100B waist 140 while the user 100A, 100B is in a standing position, when the user 100A, 100B bends over, or bends to the right or left, or makes another movement.

In this embodiment, the exoskeleton frame 10 is one-size-fits-all. The same size exoskeleton frame 10 may provide gaps 70 above differently sized user's shoulders by the position of the belt 20 along the first, second, and third vertical elements 14, 15, 16. For example, by attaching the belt 20 to a different set of slits 50, 30, 40 on the first, second, and third vertical members 14, 15, 16. As an example shown in FIG. 4, the first user 100A is taller than the second user 100B. The first user 100A is wearing the exoskeleton frame 10 with the belt 20 inserted through the middle pair of slits 30B, 40B of the second and third vertical element 14, 15 and the middle pair of slits of the first vertical element (not shown) such that the belt 20 is located at the waist line 140 of the first user 100A, and such that a gap 70 is provided between each of the shoulders 110 of the first user 100A and the first and second shoulder bands 12, 13. The second user 100B is wearing the exoskeleton frame 10 with the belt 20 inserted through the top pair of slits 30A, 40A of the second and third vertical element 15, 16 and top pair of slits of the first vertical element 14 (not shown) such that the belt 20 is located at the waist 140 of the second user 100B, and such that a gap 70 is provided between each of the shoulders 120 of the second user 100B and the first and second shoulder bands 12, 13. A user that is taller than the first user 100A may need to attach the belt 20 to the bottom sets of slits of the first, second, and third vertical members 14, 15, 16 in order to secure the exoskeleton frame 10 to the user such that a gap 70 is provided above each of the user's shoulders.

With continuing reference to FIG. 4, in this embodiment, flexibility of the frame body 11 permits the first and second shoulders 12, 13 of the exoskeleton frame 10 to compress downwards when apparel such as a protective garment is worn over the exoskeleton frame 10. The gaps 70 provided underneath each of the first and second shoulder bands 12, 13 are configured such that any compression of the first and second shoulder bands 12, 13 does not cause any force or weight of the apparel to be applied to the user's 100A, 100B shoulders, neck, spine, back, and the like. For example, the first and second shoulder bands 12, 13 are configured such that any compression by apparel worn over the exoskeleton frame 10 leaves a gap 70 between each of the user's shoulders and the first and second shoulder bands 12, 13. When apparel worn by the user 100A, 100B over the exoskeleton frame 10 is taken off, the first and second shoulder bands 12, 13 may decompress and extend upwards back into a default decompressed position. Flexibility of the frame body 11 may further permit the exoskeleton frame to be more lightweight than a rigid frame body 11 embodiment in which the frame body 11 has no flexibility. In an embodiment in which the frame body 11 is not flexible, depending on the material of the frame body 11, the frame body 11 may need to be thicker in order to be rigid such that any weight of apparel such as a protective garment is kept off of a user's 100A, 100B shoulders and spine by the first and second shoulder bands 12, 13 and gaps 70 provided thereunder.

The first and second shoulder bands 12, 13 may be configured to support apparel with differently sized shoulders. With continuing reference to FIG. 4, the first shoulder band 12 of the exoskeleton frame 10 has a width 12C, and the second shoulder band 13 of the exoskeleton frame 13 has a width 13C. The widths 12C, 13C of the first and second shoulder bands 12, 13 may be configured such that shoulders of a protective garment or other apparel worn over the exoskeleton frame 10 do not hang over the edges of the first and second shoulder bands 12, 13, but are fully supported by the widths 12C, 13C of the first and second shoulder bands 12, 13. In another embodiment, the first and second shoulder bands 12, 13 may include an adjustable width element, such as a tab that is extendable from the first and second shoulder bands 12, 13 parallel to the user's shoulders 110, 120 such that shoulders of a protective garment that are wider than the first and second shoulder bands 12, 13 are supported by the shoulder bands 12, 13 and the extended tabs. In another embodiment, the first and second shoulders 12, 13 of the exoskeleton frame may be configured to receive a shoulder extending attachment such as a shoulder pad, a panel, a tab, and the like, that can releasably affixed to each of the first and second shoulder bands 12, 13 such that the first and second shoulder bands 12, 13 are customizable in width to receive different apparel. As an example, an exoskeleton frame 10 may be sold or otherwise provided with one or more pairs of shoulder-extending attachments that may be affixed by fasteners, hook-and-loop fasteners, ridges configured to snap onto the first and second shoulder bands 12, 13, ties, buttons, hooks, and the like.

In another embodiment, the exoskeleton frame 10 may include one or more straps to further secure the exoskeleton frame 10 to a user. For example, the chest plate 17 may include one or more straps that are attachable to the back torso member 18 when the exoskeleton frame 10 is worn by a user. One or more straps on the chest plate 17 may further keep the exoskeleton frame 10 centered such that the back torso member 18 is located along a user's spine, and such that the front torso member 17 is centered in front of the user's torso when the exoskeleton frame 10 is worn.

When a user such as first and second users 100A, 100B, is wearing apparel such as a protective garment over the exoskeleton frame 10, the frame body 11 provides a barrier between the user's body and the apparel such that the apparel is not in direct contact with the user's body. This permits heat generated by the user's body to move freely without being trapped within the apparel against the user's body, which helps prevent the user from over-heating and sweating. In an embodiment, the exoskeleton frame 10 may include further temperature control features. For example, the frame body 11 may include one or more pads affixed to the inner surface 1 that are configured to rest against a user's body. As an example, an area of the inner surface 1 at the chest plate 17A may include a pad, and an area of the inner surface 1 at each of the first, second, and third vertical elements 14, 15, 16 may include a pad. In another embodiment, the frame body 11 may include one or more pockets configured to contain thermoregulating liquid or receive a pouch or enclosure of thermoregulating liquid such as chilled water or a coolant. In yet another embodiment, the frame body 11 may have a fabric covering such as cloth, polyester, cotton or the like to make the exoskeleton frame 10 soft. In one embodiment the exoskeleton frame 10 may be permanently enclosed in fabric. In another embodiment, the first, second, and third vertical elements 14, 15, 16 may be permanently or removably enclosed in fabric.

Figure 5:
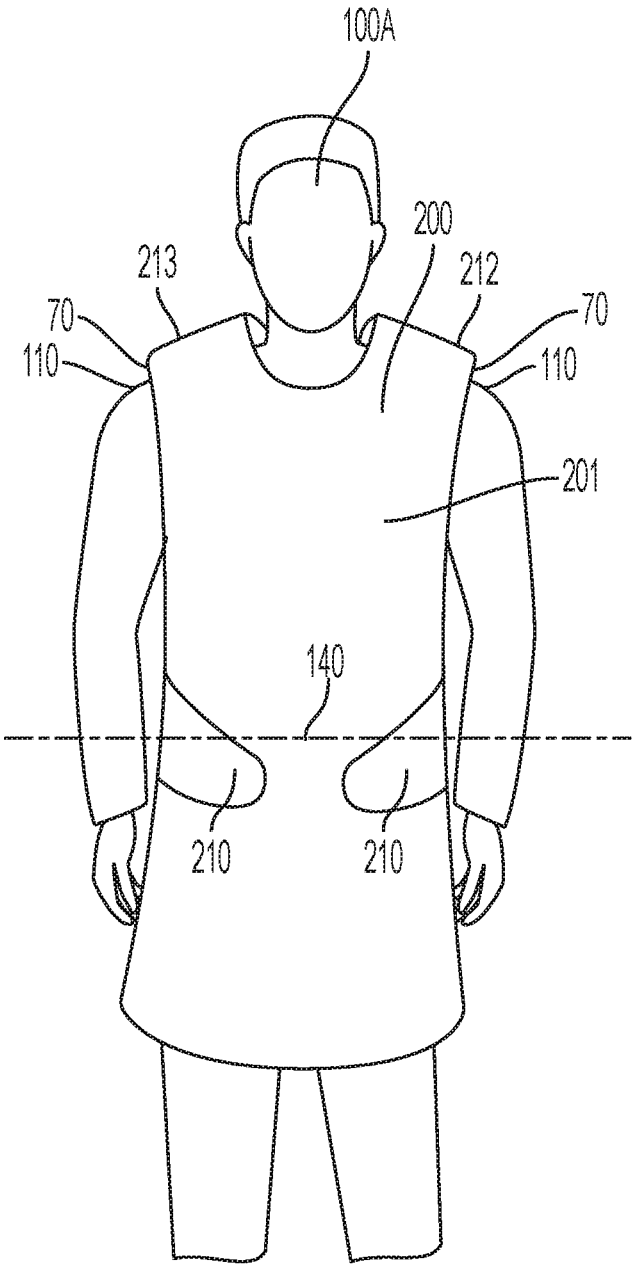
FIG. 5 depicts a front view of one of the users of FIG. 4 wearing a protective garment over the exoskeleton frame of FIGS. 1-4.

Referring now to FIG. 5, a front view is shown of the first user 100A of FIG. 4 wearing a protective garment 200 over the exoskeleton frame 10. The protective garment 200 is a lead apron of the type that a physician or health care staff may wear to protect themselves from x-rays or CT scanners. Different apparel such as body armor or other protective gear worn by military, police, and other law enforcement personnel; coats; suits; firefighter gear; and the like used by personnel in any profession involving wearable gear or protection may be worn over an exoskeleton frame 10. In this embodiment, the protective garment 200 has a front 201, a first shoulder 212 and a second shoulder 213. The protective garment 200 also has a back (not shown) and two hook-and-loop panels 210 that extend around the user 100A from the back of the protective garment 200 and attach to the front 201 thereby securing the protective garment 200 to the user 100A. The protective garment 200 is worn by the user 100A over the exoskeleton frame 10 such that the first shoulder 212 of the protective garment 200 is supported by the first shoulder band 12 of the exoskeleton frame 10 and such that the second shoulder 213 of the protective garment 200 is supported by the second shoulder 13 of the exoskeleton frame 200. The first and second shoulders 12, 13 of the exoskeleton frame 10 is supporting the protective garment 200 such that force of the weight of the protective garment 200 is not applied to the user's shoulders 110, spine, neck, or back. A gap 70 between each of the user's shoulders 110 and the first and second shoulders 212, 213 of the protective garment 200 is provided by the first and second shoulder bands 12, 13 of the exoskeleton frame 10. In this embodiment the belt 20 (not shown) of the exoskeleton frame 10 is arranged through a pair of slits on each of the first, second, and third vertical elements 14, 15,16 such that the weight of the protective garment 200 is directed to a weight-bearing area 140 of the user 100A such as the user's 100A waist. The weight-bearing area 140 may be the user's 100A waist, hips, thighs, abdomen, and the like.

The gaps 70 provided between each of the first user's 100A shoulders 210 and the first and second shoulders 212, 213 of the protective garment increases the mobility and flexibility of the user when wearing the protective garment 200. For example, the range of motion of the user's 100A arms and shoulders 110 is increased because the user's arms and shoulders 110 are not bearing the weight of the protective garment 200. This may increase the productivity and precision of the user's activity, for example, surgery preparation, surgery, and patient manipulation. These benefits are provided by the exoskeleton frame 10 when worn underneath other gear and garments as well. As another example, in the case of military and law enforcement personnel wearing body armor, gaps 70 between the first and second shoulder bands 12, 13 of the exoskeleton frame 10 and shoulders 110 of the users may increase the physical capabilities of the user by reducing muscle fatigue from the weight of the body armor, and increasing flexibility by keeping weight off of the shoulders, spine, and back of the user, thereby increasing physical abilities to move, run, lift, drag, carry, and the like. As yet another example, in the case of a firefighter wearing protective garments such as Kevlar, gaps 70 provided between the first and second shoulder bands 12, 13 of the exoskeleton frame 10 and shoulders 110 of the users may increase the physical capabilities of the user by reducing muscle fatigue from the weight of the protective garments and increasing muscle power for firefighting activities such as lifting, rescue, and the like. By keeping the weight of the protective garment 200 and other protective garments and apparel off of the user's shoulders and spine and directing the weight to a weight-bearing area of the user such as the user's abdomen, waist, thighs, or hips, deleterious effects of wearing a heavy apparel such as a protective garment are prevented, for example, neck pain, back pain, orthopedic injury, musculoskeletal damage, Interventionalist's Disc Disease, and the like. Further, apparel such as lead aprons often applies a force on a user's neck, shoulders, and back that pulls the user's neck, shoulders, and back forward due to the weight of a protective garment. Wearing an exoskeleton frame 10 underneath such a protective garment prevents this pulling force from being applied to the user and injuring a user's neck, shoulders, and back. Accordingly, early retirement, missed work days, and compromised work performance may thereby be decreased.

In one embodiment, the exoskeleton frame 10 may include one or more sensors that monitor one or more health metrics of a user. As an example, one or more sensors may be affixed to the inner surface 1 or outer surface 2 of the exoskeleton frame 10. One or more sensors may be affixed to the exoskeleton frame by adhesive, a pocket, a button, a fastener, hook-and-loop enclosures, and the like. One or more sensors on the exoskeleton frame 10 may measure heart rate, EKG, breathing rate, internal body temperature, external body temperature, temperature of a space in between the user and a protective garment worn over the exoskeleton frame 10, and the like. The one or more sensors may be configured to transmit measured data. For example, one or more sensors may transmit by Bluetooth, Wi-Fi, and the like.

Figure 6:
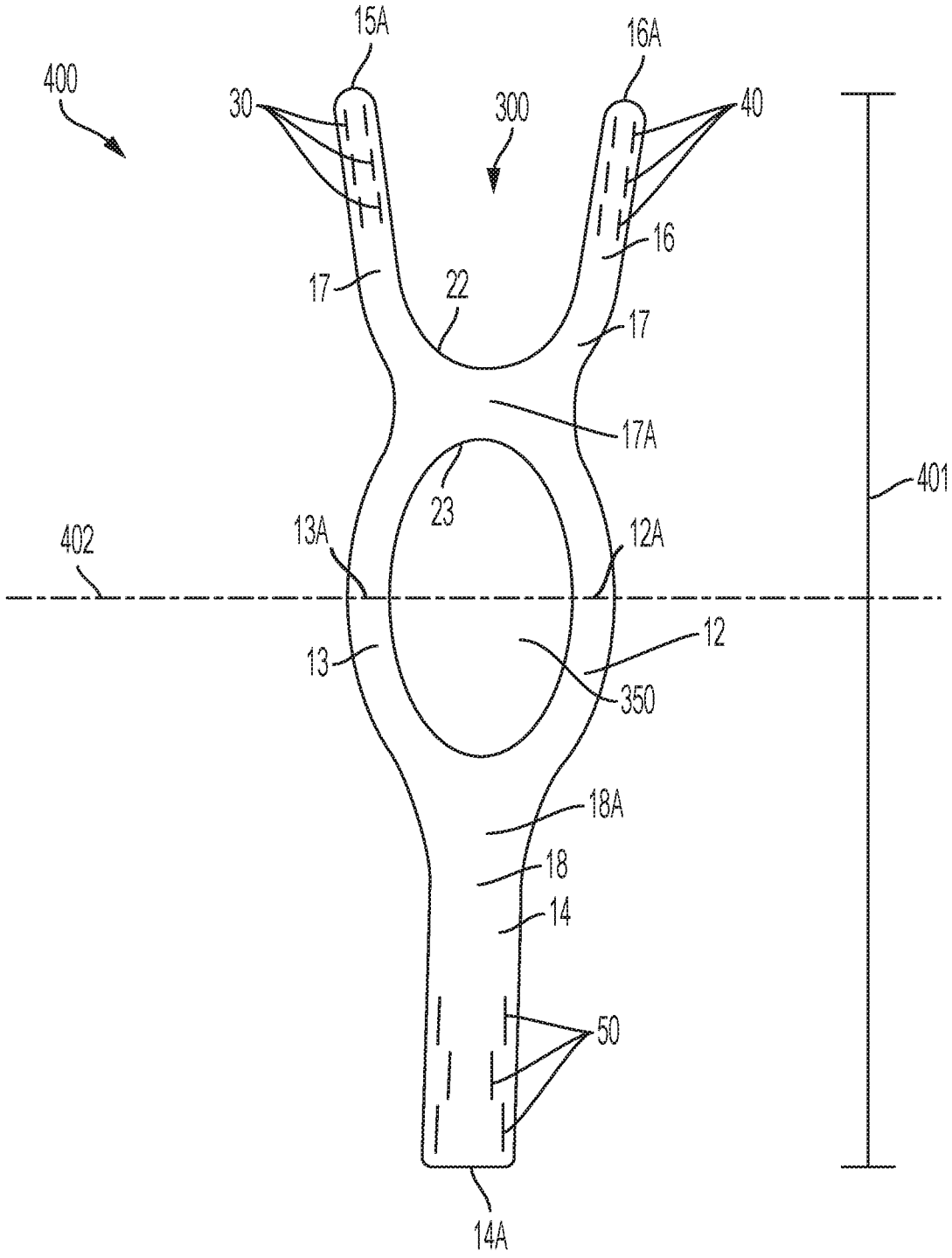
FIG. 6 depicts a front view of a preformed frame body of the exoskeleton frame of FIGS. 1-4.

With reference to FIG. 6, a front view is shown of a preformed frame body 400 of an exoskeleton frame 10 in a step of a method of making the exoskeleton frame 10. The preformed frame body 400 may be formed, for example cut, out of a sheet of material such as plastic, for example, low-density polyethylene, such that the preformed frame body 400 includes back torso member 16 and front torso member 17. The preformed frame body 400 has been cut such that the front torso member 17 includes the second vertical element 15 and third vertical element 16. The preformed frame body 400 has been cut such that the second vertical element 15 and third vertical element 16 have a space 300 between the second vertical element 15 and third vertical element 16. The preformed frame body 400 has further been cut to include an opening 350 which, when the preformed frame body 400 is shaped into the frame body 11, will define a space within which a user's neck and head will be located when the exoskeleton frame 10 is worn by the user. The preformed frame body 400 has a length 401 that extends between the first end 16A of the back torso member 18 to the second and third ends 15A and 16A. The preformed frame body 400 has a center point 402 at the center of the length 401. The center point 402 defines a bend location where the preformed frame body 400 may be bent or curved in half such that a first top edge 12A of the first shoulder band 12 and a second top edge 13A of the second shoulder band 13 are formed at the center point 402.

A method of making an exoskeleton frame 10 may include providing a piece of material; forming a preformed frame body, such as preformed frame body 400, out of the piece of material, such that the preformed frame body includes a first shoulder band, such as first shoulder band 12, a second shoulder band, such as second shoulder band 13, an opening between the first shoulder band and second shoulder band, such as opening 350, a front torso member, such as front torso member 17, and a back torso member, such as back torso member 18; manipulating the preformed frame body into a frame body, such as frame body 11, such that when the frame body is worn by a user, the first shoulder band and second shoulder band are located above a first shoulder and a second shoulder of the user, the front torso member is located in front of a torso of the user and the back torso member is located along a back of the torso of the user; and attaching an adjustable belt such as belt 20 to the front torso member and back torso member.

A method of making an exoskeleton frame may include forming the preformed body out of the piece of material such that the back torso member includes a first vertical element, such as first vertical element 14, having a first end, such as first end 14A, and such that the front torso member includes a chest plate, such as chest plate 17A, a second vertical element, such as second vertical element 15, having a second end, such as second end 15A, and a third vertical element, such as third vertical element 16, having a third end, such as third end 16A, wherein the first shoulder band and second shoulder band extend from the chest plate to the back torso member, wherein the second vertical element and third vertical element extend from the chest plate opposite the first shoulder band and second shoulder band.

A method of making an exoskeleton frame may include forming the preformed body out of the piece of material such that a space, such as space 300, is located between the second vertical element and the third vertical element.

A method of making an exoskeleton frame may include forming at least one belt attachment structure in each of the front torso member and back torso member.

In an embodiment of a method of making an exoskeleton frame, manipulating the piece of material into a frame body may include bending the preformed frame body such that a first end of the back torso member is aligned with a second end of the front torso member. The method may further include applying heat to the preformed frame body while the preformed frame body is bent.

In an embodiment of the method, the piece of material may be a low-density polyethylene. In another embodiment, the piece of material may be a flat sheet of material.

In a method of making an exoskeleton frame, forming a preformed frame body out of the piece of material may include cutting the piece of material. In another embodiment, forming a preformed frame body out of the piece of material may include stamping the piece of material.

In one embodiment, a method of making an exoskeleton frame may include forming at least one belt attachment structure, such as one or more pairs of slits 50, 30, 40 on or in each of the back torso member, first vertical element, and second vertical element. The method may further include removably attaching a belt to each of the at least one belt attachment structure on or in each of the first, second, and third vertical elements.

In one embodiment a method of making an exoskeleton frame may include loading an electronic file containing computer instructions for forming the preformed frame body into a cutter or stamper, for example, a computer numeral controlled router machine, and the cutter may cut the preformed frame body out of a piece of rigid material, for example, a thick sheet of low-density polyethylene. The method may include bending the preformed frame body in half at a mid-point such as mid-point 402 along a length, such as length 401 of the preformed frame body, into a frame body, and placing the preformed frame body in a shape guiding tool such as a jig, and holding the frame body, for example, by a clamp, strap, and the like. The method may include applying heat to the frame body, for example, by a hot air gun, cooling the frame body, and removing the frame body from the shape guiding tool.

In one embodiment, the preformed frame body may be cut from a sheet of material. In another embodiment, the preformed frame body may be stamped out of a sheet of material. In another embodiment, a plurality of preformed frame bodies may be formed from a plurality of sheets of material at the same time, for example, by stamping the preformed frame bodies out of the plurality of sheets of material.

In an embodiment, a method of making an exoskeleton frame may include affixing one or more pads, temperature control devices, or sensors on the frame body, such as an inner surface, for example, inner surface 1, of the frame body. In another embodiment, a method of making an exoskeleton frame may include bending the front torso portion along a center line, such as center line 500, extending vertically along the center of the front torso portion such that the front torso portion is curved, and such that when a user is wearing the frame body, the front torso portion curves about the front of the user's torso. The method may further include heating the frame body 11 while the front torso portion is bent along the center line to produce the curve of the front torso portion.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. An exoskeleton frame comprising:

a frame body made of a single flat continuous piece of flexible material configured to be manipulated such that in a first position, the single flat continuous piece of flexible piece of material is bent and includes a front torso member positioned such that when the exoskeleton frame is worn by a user the front torso member is located along a front of a torso of the user;

a back torso member positioned such that when the exoskeleton frame is worn by a user the back torso member is located along a back of the torso of the user;

a first shoulder band located at a bend of the single flat continuous piece of material, the first shoulder band extending from the front torso member to the back torso member;

a second shoulder band located at the bend of the single flat piece of material, the second shoulder band extending from the front torso member to the back torso member; and an opening positioned between the first shoulder band and second shoulder band such that when the exoskeleton frame is worn by a user, a neck of the user is located within the opening, wherein the single flat continuous piece of flexible material is configured to be manipulated such that in a second position, the single flat continuous piece of flexible material is at least partially unbent such that the front torso portion is moved away from the back torso portion; and an adjustable belt removably attached to the front torso and back torso member, wherein the adjustable belt is configured to direct a weight of apparel that is worn by the user over the exoskeleton frame to a weight-bearing area of the user located between knees and abdomen of the user, and wherein the first shoulder band and second shoulder band are configured to support the weight of the apparel such that the weight of the apparel is held off of a first shoulder and a second shoulder of the user.

2. The exoskeleton frame of claim 1, wherein the front torso member and back torso member each include at least one belt attachment structure configured to attach the adjustable belt to the exoskeleton frame.

3. The exoskeleton frame of claim 2, wherein the at least one belt attachment structure includes a plurality of slits configured to securably receive the adjustable belt.

4. The exoskeleton frame of claim 1, wherein the back torso member includes a first vertical element having a first end, wherein the front torso member includes:

a chest plate positioned such that when the exoskeleton frame is worn by the user the chest plate is located in front of a chest area of the user;

a second vertical element having a second end; and a third vertical element having a third end, wherein the first shoulder band and second shoulder band extend from the chest plate to the back torso member, wherein the second vertical element and third vertical element extend from the chest plate opposite the first shoulder band and second shoulder band.

5. The exoskeleton frame of claim 4, wherein the first vertical element includes a first plurality of slits located proximate to the first end, wherein the second vertical element includes a second plurality of slits located proximate to the second end, wherein the third vertical element includes a third plurality of slits located proximate to the third end, wherein the first plurality of slits, second plurality of slits, and third plurality of slits are configured to receive the adjustable belt such that the adjustable belt is securable to the exoskeleton frame at different locations along the first vertical element, second vertical element, and third vertical element.

6. The exoskeleton frame of claim 1, wherein the front torso member includes a space positioned such that when the user is wearing the exoskeleton frame, the space is located in front of a stomach area of the user.

7. The exoskeleton frame of claim 1, wherein when the exoskeleton frame is worn by a user, a first gap is located between the first shoulder of the user and the first shoulder band, and a second gap is located between the second shoulder of the user and the second shoulder band.

8. The exoskeleton frame of claim 7, wherein the first shoulder band and second shoulder band are configured to compress while maintaining the first gap and second gap by holding the apparel off of the first shoulder and the second shoulder of the user when apparel is worn over the exoskeleton frame by the user.

9. The exoskeleton frame of claim 1, wherein a space between the front torso member and back torso member is adjustable to fit differently sized users by lengthening or shortening a length of the adjustable belt.

10. A method comprising:

providing a single flat continuous piece of flexible material configured to be manipulated such that in a first position, the single flat continuous piece of flexible piece of material is bent and includes a front torso member positioned such that when the exoskeleton frame is worn by a user the front torso member is located along a front of a torso of the user;

a back torso member positioned such that when the exoskeleton frame is worn by a user the back torso member is located along a back of the torso of the user;

a first shoulder band located at a bend of the single flat continuous piece of material, the first shoulder band extending from the front torso member to the back torso member;

a second shoulder band located at the bend of the single flat piece of material, the second shoulder band extending from the front torso member to the back torso member; and an opening positioned between the first shoulder band and second shoulder band such that when the exoskeleton frame is worn by a user, a neck of the user is located within the opening, wherein the single flat continuous piece of flexible material is configured to be manipulated such that in a second position, the single flat continuous piece of flexible material is at least partially unbent such that the front torso portion is moved away from the back torso portion;

forming a preformed frame body out of the single flat continuous piece of flexible material by bending the single flat continuous piece of flexible material, such that the preformed frame body includes a first shoulder band located at a bend of the single flat continuous piece of flexible material, the first shoulder band, a second shoulder band located at the bend of the single flat piece of flexible material, the second shoulder band, an opening between the first shoulder band and second shoulder band, a front torso member, and a back torso member; and manipulating the preformed frame body into a frame body such that when the frame body is worn by a user, the front torso member is located in front of a torso of the user and the back torso member is located along a back of the torso of the user, and the first shoulder band and second shoulder band are configured to support the weight of apparel that is worn by the user over the frame body such that the weight of the apparel is held off of a first shoulder and a second shoulder of the user.

11. The method of claim 10, including attaching an adjustable belt to the front torso member and back torso member.

12. The method of claim 10, including forming the preformed body out of the single flat continuous piece of flexible material such that the back torso member includes a first vertical element having a first end, and such that the front torso member includes:

a chest plate;

a second vertical element having a second end; and a third vertical element having a third end, wherein the first shoulder band and second shoulder band extend from the chest plate to the back torso member, wherein the second vertical element and third vertical element extend from the chest plate opposite the first shoulder band and second shoulder band.

13. The method frame of claim 12, including forming the preformed body out of the piece of material such that a space is located between the second vertical element and the third vertical element.

14. The method frame of claim 10, including forming at least one belt attachment structure in each of the front torso member and back torso member.

15. The method frame of claim 10, wherein the manipulating the single flat continuous piece of flexible material into a frame body includes bending the preformed frame body such that a first end of the back torso member is aligned with a second end of the front torso member.

16. The method of claim 15, including applying heat to the preformed frame body while the preformed frame body is bent.

17. The method of claim 10, wherein the single flat continuous piece of flexible material is a high-density polyethylene.

18. The method of claim 10, wherein the forming a preformed frame body out of the single flat continuous piece of flexible material includes at least one of cutting and stamping the piece of material.

19. An exoskeleton frame comprising:

a frame body made of a single flat continuous piece of flexible material configured to be manipulated such that in a first position, the single flat continuous piece of flexible piece of material is bent and includes a front torso member positioned such that when the exoskeleton frame is worn by a user the front torso member is located along a front of a torso of the user;

a back torso member positioned such that when the exoskeleton frame is worn by a user the back torso member is located along a back of the torso of the user;

a first shoulder band located at a bend of the single flat continuous piece of flexible material, the first shoulder band extending from the front torso member to the back torso member;

a second shoulder band located at the bend of the single flat continuous piece of flexible material, the second shoulder band extending from the front torso member to the back torso member; and an opening positioned between the first shoulder band and second shoulder band such that when the exoskeleton frame is worn by a user, a neck of the user is located within the opening, wherein the single flat continuous piece of flexible material is configured to be manipulated such that in a second position, the single flat continuous piece of flexible material is at least partially unbent such that the front torso portion is moved away from the back torso portion, wherein the front torso member and back torso member are configured to receive an adjustable belt that is configured to direct a weight of apparel that is worn by the user over the exoskeleton frame to a weight-bearing area of the user located between knees and abdomen of the user, and wherein the first shoulder band and second shoulder band are configured to support the weight of the apparel such that the weight of the apparel is held off of a first shoulder and a second shoulder of the user.

20. The exoskeleton frame of claim 19, wherein the back torso member includes a first vertical element having a first end, wherein the front torso member includes:

a chest plate positioned such that when the exoskeleton frame is worn by the user the chest plate is located in front of a chest area of the user;

a second vertical element having a second end; and a third vertical element having a third end, wherein the first shoulder band and second shoulder band extend from the chest plate to the back torso member, wherein the second vertical element and third vertical element extend from the chest plate opposite the first shoulder band and second shoulder band.

21. A method comprising:

providing the exoskeleton frame of claim 19; and wearing the exoskeleton frame, by a user, such that the first shoulder band and second shoulder band are positioned above a first shoulder and second shoulder of the user, and such that a first gap is between the first shoulder and first shoulder band, and a second gap is between the second shoulder and second shoulder band.

22. The method of claim 21, wherein the first shoulder band and second shoulder band are compressible such that the first gap and second gap are maintained when the apparel is worn by the user over the exoskeleton frame, and decompressible when the apparel is taken off by the user.

* * * * *